US009428250B2

(12) United States Patent
Serlachius

(10) Patent No.: US 9,428,250 B2
(45) Date of Patent: Aug. 30, 2016

(54) MOORING COMPENSATOR

(75) Inventor: Jarl Fredrik Serlachius, Kauniainen (FI)

(73) Assignee: TSCompany Limited OÜ, Kunda (EE)

( * ) Notice: Subject to any disclaimer, the term of this patent is extended or adjusted under 35 U.S.C. 154(b) by 1126 days.

(21) Appl. No.: 12/935,915

(22) PCT Filed: Apr. 22, 2009

(86) PCT No.: PCT/FI2009/000051

§ 371 (c)(1),
(2), (4) Date: Oct. 1, 2010

(87) PCT Pub. No.: WO2009/130365

PCT Pub. Date: Oct. 29, 2009

(65) Prior Publication Data

US 2011/0023767 A1 Feb. 3, 2011

(30) Foreign Application Priority Data

Apr. 22, 2008 (FI) ..... 20080305

(51) Int. Cl.
*B63B 21/00* (2006.01)
*B63B 21/04* (2006.01)

(52) U.S. Cl.
CPC ..... *B63B 21/04* (2013.01); *B63B 21/00* (2013.01)

(58) Field of Classification Search
CPC ..... B63B 21/04; B63B 21/00
USPC ..... 114/218; 24/129 D, 129 W, 115 A
See application file for complete search history.

(56) References Cited

U.S. PATENT DOCUMENTS

| | | | | |
|---|---|---|---|---|
| 3,043,902 | A * | 7/1962 | Klein | 174/146 |
| 3,751,772 | A * | 8/1973 | Grandjanny | 24/115 A |
| 5,205,803 | A * | 4/1993 | Zemitis | 482/121 |
| 5,229,178 | A * | 7/1993 | Zemitis | 428/37 |
| 6,735,829 | B2 * | 5/2004 | Hsu | 24/712.1 |
| 6,868,586 | B1 * | 3/2005 | Hall | 24/115 A |

FOREIGN PATENT DOCUMENTS

| | | |
|---|---|---|
| DE | 102007014822 | 4/2008 |
| FI | 87724 C | 2/1993 |
| FI | 89554 C | 10/1993 |
| WO | WO 2009/130365 | 10/2009 |

* cited by examiner

*Primary Examiner* — Stephen Avila
(74) *Attorney, Agent, or Firm* — Seppo Laine Oy

(57) ABSTRACT

The object of the invention is a mooring compensator not needing any rope threading; instead, even after the boat is moored, it can effortlessly be fastened onto any rope (6) with a simple loop (7, 8). The special characteristic of the mooring compensator is that, when pulled, the openings (9, 9A) at the end elements (2, 2A) of the mooring compensator close, thereby efficiently preventing the loop (7, 8) in the boat rope (6) from sliding out of the opening (9, 9A) and from opening.

8 Claims, 2 Drawing Sheets

MOORING COMPENSATOR

Figure 1:
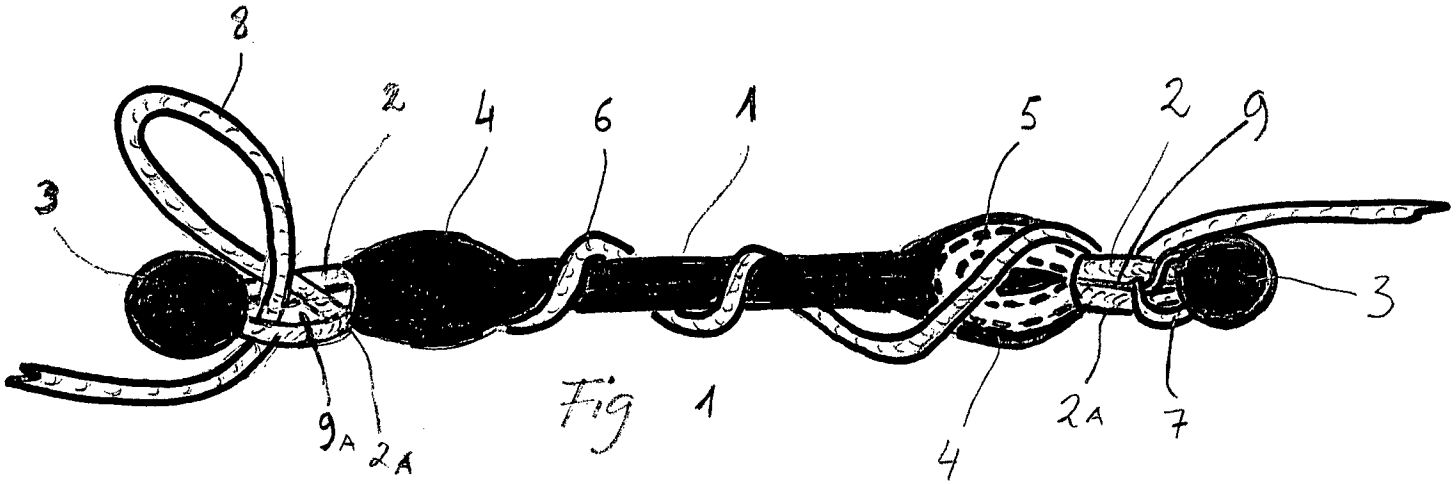

The invention comprises a mooring compensator installed on a rope.

Throughout the ages, boats have been moored using ropes or other similar bendable longitudinal elements. Ropes are best suited for this purpose as they already are bendable and, hence, as such, already act as mooring compensators. But a rope alone is not enough to compensate the stormy shocks caused by waves, which can break a boat's mooring devices with bad results. This is the reason for launching the first mooring compensators into the market already immediately after the wars.

A mooring compensator is an apparatus made of resilient, bendable material installed onto a rope to add rope flexibility, thereby compensating any shocks emerging.

There are two main types of mooring compensators in the market: those to be threaded onto a rope and those not to be threaded onto a rope There is also a third type, a tieable, made of metal, but it is heavy, impractical, and noisy, and, therefore, not used as a boat equipment, but it can still be found as a standard home pier mooring device. This metal mooring compensator is considered to be of the non-threadable type.

Depending on the type of mooring, mooring compensators require different manufacturing material. Threadable mooring compensators fasten onto a rope with friction, and, for this reason, this mooring compensator type is entirely made of rubber. The rope is threaded through the tight openings at the end elements of the mooring compensator, whereupon the friction created between the rubber-surfaced openings and the ropes make the mooring compensator stick to the rope. On the other hand, non-threadable mooring compensators are fastened onto a rope with a loop or knot in the rope itself. When pulled, the rope tightens, and the loop or knot easily forces itself through the rubber material, for which reason the ends of non-threadable mooring compensators are made of hard material.

Hence, mooring compensators function so that their end elements are fastened non-glidingly onto a rope and the rope is left loose between the fastening points. This loose part is mostly wound around the frame of the mooring compensator before its both ends are fastened onto the rope. The compensation takes place so, that the shock load directed on the rope so to say removes the looseness in the rope. In order for this to be possible, the fastening points in the rope cannot give in.

Threadable mooring compensators are fastened onto a rope with resistance or friction. The rope is laboriously threaded through the openings at the end of the mooring compensator where the diameter of the openings is a little smaller than the rope diameter, whereupon the friction generated locks the rope in place. The precondition for the fastening to hold is that the diameter of the openings through which the rope is threaded is somewhat smaller than that of the rope. The procedure is difficult and, after mooring, the mooring compensator cannot be moved.

There certainly are threadable mooring compensators in the market, in which the opening or the openings intentionally are larger than the rope diameter. It is easier to fasten and also remove the mooring compensator, but it functions poorly, because a shock so to say removes looseness, whereupon the rope only tries to straighten, not stretching the mooring compensator enough when giving in upon mooring.

A functioning threadable mooring compensator represents a permanent solution, meaning that the intention is not to remove the mooring compensator from the rope. It is permanently fastened onto the rope, which is a functioning solution at the home harbour as it is fastened on a piece of rope in the same location at the home pier when sailing out. But there are situations where, always according to the situation, it is very good to be able to install a mooring compensator at the exact place it is needed at any given moment. In such a case, a permanent solution is not ideal. Sometimes, when the anchor does not hold a boat steady at high wind, it is good to have a mooring compensator in the boat that is easy to fasten rapidly onto some other rope. Also, in various shoring situations, a threadable mooring compensator is cumbersome when a rope is thrown to be received on shore and when looking for a place to tighten the rope onto, in which case a permanent mooring compensator often is located in a wrong place.

In these varying conditions, the handiest solution is to use a non-threadable mooring compensator, which can be placed onto a rope always according to the situation.

It works so, that a loop in the mooring rope is pulled through an opening in the mooring compensator and the loop is locked onto the mooring compensator by taking either a detached pin of the mooring compensator through the loop or by threading the loop over a pin fastened onto the mooring compensator. When the rope tightens, the loop tightens around the pin.

In the detached pin solution, the rope leans against the pin, which pin then leans against the opening in the mooring compensator, thereby locking it.

In an integrated solution, where the pin is a fixed part of the mooring compensator's end element, the loop is twisted half a round before it is placed over the pin, whereupon the sliding knot created tightens when pulled and locks itself around the mooring compensator pin.

Both solutions have their own weaknesses. In order for the detached pin solution to work, both the pin and the opening must be made of an extremely robust material, so that, due to the pulling force, the pin does not bend through the opening. If the solution is based on the fact that the entire flexing is the result of the pin made of rubber sinking onto the bottom of the opening, the flexing is practically non-existent and, therefore, useless. Consequently, as the mooring compensator is solely composed of a rubber opening and a pin, this solution entirely lacks a longitudinal stretchable frame. And, the solution is not applicable to the end elements of a stretchable frame, as the solution would not be able to endure pulling. On the other hand, if the solution is desired for locking the rope at the end elements of a mooring compensator, it must be made of steel, which, for safety reasons, is not recommended as a rope fixture. The intention is to throw the rope from the boat to people on the pier, so steel solutions could be damaging. Furthermore, a detached pin is a troublesome attachment and easy to lose.

A mooring compensator equipped with a fixed pin solution partially has the same weaknesses. In order for the mooring compensator end element to endure, it should be made out of steel, in which case the solution created would be heavy and dangerous. But, considering the overall functionality of the solution, we are again faced with the fact that steel is a hard material. That is, along with heavy boat load, the rope is subjected to a pulling force of several tons and the loop around the pin tries to twist the mooring compensator's entire steel end element, with the pins, to the side and down with the same kg weight. As the steel element itself does not give in, it tends to twist loose from the mooring compensator's stretchable frame, which, in time, will also happen. On the other hand, if the mooring compensator end elements are made of plastic material, which is one solution arrived at in the market, when pulled, due to the force from the tightening loop, the pin tries to turn down toward the opening, and when the pin has turned enough down, the loop's tightening force disappears and the grip onto the rope loosens.

The U.S. Pat. No. 3,817,507 is an example of a permanent threadable mooring compensator, and FI 903568 and EP 0 539 394 B1 are examples of a non-threadable mooring compensator.

Today, the boating world agrees that a functioning non-threadable mooring compensator represents future and will replace the almost outdated threadable mooring compensator.

Non-threadable mooring compensators are not only easier to attached onto a rope; instead, their greatest advantage is considered to be the fact that, for them to work, non-threadable mooring compensators are not confined to a certain rope type or size. They also work splendidly with the so-called flat Ankarolina, which is very popular today.

The invention presented here offers a solution to those problems with which the non-threadable mooring compensators in the market are still struggling. This solution is arrived at with a non-threadable mooring compensator equipped with a stretchable frame, characteristic in that at the actual end elements of the mooring compensator's frame consists of at least one bendable element(s) equipped with end stoppers and enduring torque load.

Traditionally, the stretchable frame of a mooring compensator is preferably made of rubber or related matter, but any rubber material with the attributes of rubber is suitable for this purpose. The purpose of the frame is not to stand infinite pulling but, for a certain length, to allow stretchable resistance to pulling, thereby acting as a mooring compensator. But, instead, the frame end elements must preferably endure pulling as much as the rope onto which the mooring compensator is fastened. This feature is not required of such mooring compensators, which are permanently fastened onto a rope, as they are locked onto a rope with the friction generated between the mooring compensator's tight openings and the rope threaded through them. But the new generation non-threadable detachable mooring compensators are fastened onto a rope with a knot or loop in the rope, which knot or loop, due to the pulling load directed on the rope, tightens the mooring compensator end elements with enormous power. Depending on the size of the boat tied onto the rope, this load can be up to several tons. Hence, the material for the mooring compensator end elements has to meet high material standards. As stated above, hard material flexes in a tightening rope and may bend loose from the rubber frame or a pin may bend out of the opening.

Non-threadable mooring compensators, which still represent a large minority, struggle with problem of how to get the end elements to endure the tight grip of the rope loop or knot. The solution to the problem is bending. In other words, there is no struggle against powers, to the contrary. Bending takes place entirely with their terms and struggling only takes place against the necessary pulling.

Consequently, in the solution presented here, the mooring compensator's end elements are preferably made of two parallel, bendable, non-stretching longitudinal elements that endure pulling and torque load, which end elements, when pulled, lean against each other, to prevent the stopper at the end of the elements from bending out between the elements. Compared to hard end elements, the advantage of a bendable mooring compensator's end elements is the conforming to the load directed at it, not trying to resist it. The powers directed at the mooring compensator are pulling and torque load and bending through the loop or knot. Those are opposite powers, the pull trying to straighten and the loop trying to bend. In case of a hard material, this results in an unnatural pull-bend stress on the material, which has damaging consequences. A hard material either bends loose from the rubber frame or fatigues and brakes. But if the material is bendable, there being no torque resistance due to the bendable characteristic of the mooring compensator's end element, the only stress it is subjected to is pulling.

Any durable, bendable materials are suited for manufacturing the end elements and the most recommended materials are those used for manufacturing rope. Hence, as such, a rope enduring hard use is ideally suited for use as mooring compensator end elements. A handy fastening method is vulcanising a loop onto the frame when making the frame in a casting mould. Both of the free rope ends are joined in the stopper, which, for its part, can be fastened onto the ends by vulcanisation. The method, with which the stopper is fastened onto the end elements, is not of essence. But, it is essential for the stopper to hold the ends tightly together. The pull from the rope must not separate the ends from each other. Bendable end elements are also an ideal solution in such a sense that they have two opposite characteristics that are required of an ideally functioning non-threadable mooring compensator: both the opening that opens and closes, which, when loose, for fastening, first allows the loop to go through and then, when pulled, is rigid, preventing it from getting out of the opening.

The length of the end elements is determined based on the fact that the loop of the boat rope has to fit in between these parallelly moving end elements, i.e., the rope folded in two. Hence, the length of the end elements can vary between circa 2 to 6 cm, depending on the rope thickness. The diameter of the stopper is within the same range.

Instead of vulcanisation, i.e., permanent fastening, the ends can also be fastened onto a stretchable frame with quick fastening. In such a case, after an end element is worn out, it can be replaced. In such a case, the fastening can take place so that, e.g., sleeved loops are integrated in the rubber frame, onto which a carbine-like hook fastened onto the other end of the bendable end element is fastened. Or vice versa, so that the carbine-like hook is fastened onto the rubber frame, onto which the loop at the end of the bendable end element is fastened.

As stated above, a mooring compensator's bendable end elements consist of two parallel elements, but the solution also works with one bendable end element equipped with a stopper. However, this solution is not as practical for the reason that, for it to lock, instead of a loop, it requires a real knot, for example a bowline knot, in the boat rope. Hence, an end part with two elements is recommended.

The following is the presentation of the invention, with references to the appended drawings where FIG. 1 presents a mooring compensator fastened onto a rope so, that a loop lock has already been created at the other end, while one is being prepared at the other end.

Figure 2:
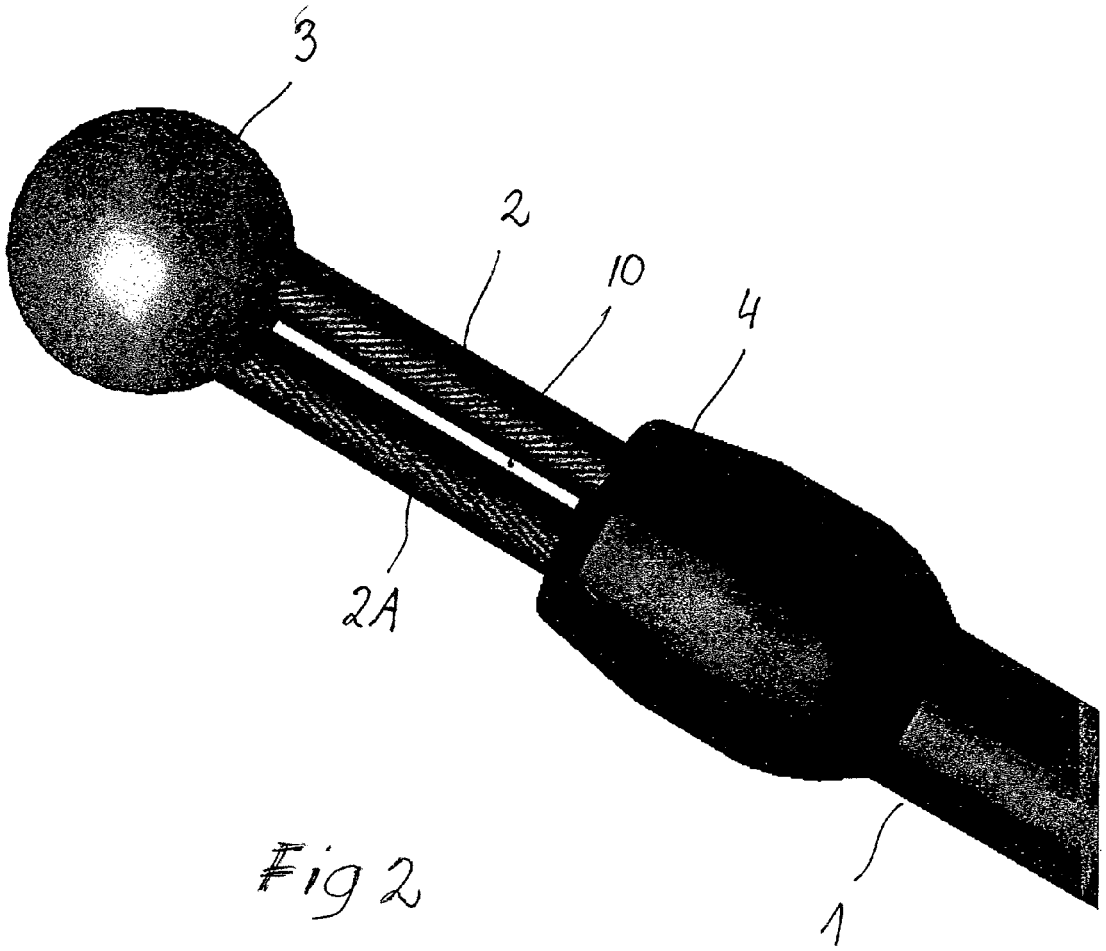

FIG. 2 presents the other end of a mooring compensator, with parallel ropes ending at a ball-like stopper.

FIG. 1 shows a rope (6) wound around a mooring compensator, in which rope the loop (7) is locked around the bendable end element (2, 2A) of the frame (1) at the other end of the mooring compensator, which loop (7), because of the stopper (3) and the interlocking ends (2, 2A) resulting from pulling, cannot retract through the opening (9) between the end elements (2, 2A). At the opposite end, for taking it over the stopper (3), the rope (6) loop (8) is pulled through an opening (9A) in the bendable end element (2, 2A). The cross section shows, how the bendable end element (2, 2A) of the frame (1) is fastened inside by vulcanising it onto the frame (1) end (4) in the form of a loop (5).

FIG. 2 shows the other end of a mooring compensator, in which a mooring compensator's bendable end element (2, 2A), with its basic form with the opening closed (10), is fastened by vulcanising it onto the frame-side end (4), where the other ends are fastened onto a ball-like stopper (3).

The description and the related drawings are only intended for illustrating the concept according to the invention. The details of the mooring compensator according to the invention may vary within the framework of the claims.

The invention claimed is:

1. A non-threadable mooring compensator comprising:

a resilient stretchable frame, at least two parallel, bendable longitudinal end elements mounted onto and extending from the frame, wherein the end elements are joined together with a thicker end stopper, and the end elements, when at rest, form an accessible opening meant to be manually opened further into an opening sufficient for a boat rope loop, wherein the end elements, when under stress or when pulled, are capable of closing by themselves tightly around the boat rope loop, and wherein the end elements are made of bendable, non-stretching material that endures pulling and torque loading.

2. A mooring compensator according to claim 1, wherein the end elements are formed of ropes.

3. A mooring compensator according to claim 1, wherein the end stopper is made of rubber or related soft, resilient material, onto which the end elements are tightly anchored by vulcanization.

4. A mooring compensator according to claim 1, wherein the end elements are formed of ropes.

5. A mooring compensator according to claim 1, wherein the end stopper is made of rubber or related soft, resilient material, onto which the end elements are tightly anchored by vulcanization.

6. A mooring compensator according to claim 2, wherein the end stopper is made of rubber or related soft, resilient material, onto which the end elements are tightly anchored by vulcanization.

7. A mooring compensator according to claim 4, wherein the end stopper is made of rubber or related soft, resilient material, onto which the end elements are tightly anchored by vulcanization.

8. A mooring compensator according to claim 1, wherein the at least two parallel, bendable longitudinal end elements are manually bendable.

* * * * *